US010352092B2

(12) United States Patent
DeGraaf

(10) Patent No.: US 10,352,092 B2
(45) Date of Patent: Jul. 16, 2019

(54) RECESSED PERSONAL PROTECTION EQUIPMENT DISPENSERS

(71) Applicant: Dante G DeGraaf, Arlington, WA (US)

(72) Inventor: Dante G DeGraaf, Arlington, WA (US)

(73) Assignee: Bowman Manufacturing Company, Inc., Arlington, WA (US)

( * ) Notice: Subject to any disclaimer, the term of this patent is extended or adjusted under 35 U.S.C. 154(b) by 0 days.

(21) Appl. No.: 14/803,982

(22) Filed: Jul. 20, 2015

(65) Prior Publication Data

US 2015/0320238 A1 Nov. 12, 2015

Related U.S. Application Data

(63) Continuation-in-part of application No. 14/708,673, filed on May 11, 2015, now abandoned.

(60) Provisional application No. 61/832,099, filed on Jun. 6, 2013.

(51) Int. Cl.

| | |
|---|---|
| ***A47B 67/00*** | (2006.01) |
| ***E06B 5/00*** | (2006.01) |
| ***A47F 3/06*** | (2006.01) |
| ***A47B 81/00*** | (2006.01) |
| ***E04F 19/08*** | (2006.01) |
| *A47F 3/02* | (2006.01) |

(52) U.S. Cl.

CPC ..... *E06B 5/006* (2013.01); *A47B 67/00* (2013.01); *A47B 81/00* (2013.01); *A47F 3/06* (2013.01); *E04F 19/08* (2013.01); *A47F 3/02* (2013.01)

(58) Field of Classification Search

CPC ..... A47B 81/00; A47B 67/02; A47B 67/04; A47B 96/00; A47B 67/00; G07F 11/60; G07F 11/62; G07F 17/0092; A61G 12/00; A61G 12/001; A61G 12/005; A61J 1/16; A61J 7/0076; F16M 11/04; F16M 11/10; F16M 11/2014; F16M 11/24; F16M 13/02; E06B 5/00; E06B 7/28; E06B 5/006; H05B 3/84; B60J 1/1853; A47F 3/06; E04F 19/08

USPC ..... 312/138.1, 209, 321.5, 311, 292, 245, 312/242, 324, 212, 34.24, 265.6, 211, 312/34.23; 248/278.1, 124.1; 49/70, 501

See application file for complete search history.

(56) References Cited

U.S. PATENT DOCUMENTS

| | | | | |
|---|---|---|---|---|
| 2,911,175 A | | 11/1959 | Erie | |
| 3,269,593 A | | 8/1966 | Madeleine et al. | |
| 3,982,659 A | | 9/1976 | Ross | |
| 4,408,811 A | * | 10/1983 | Richardson | A47K 10/24 312/138.1 |
| 4,678,099 A | | 7/1987 | Matsui | |

(Continued)

*Primary Examiner* — James O Hansen

(74) *Attorney, Agent, or Firm* — Schacht Law Office, Inc.; Michael R. Schacht

(57) ABSTRACT

The present invention generally relates to modular recessed dispensers for holding consumable products such as, but not limited to, disposable latex gloves, gowns, masks that may be contained within a consumables box. In one embodiment, the modular recessed dispensers include replaceable doors or front panels and adjustable shelves and dividers that may be quickly reconfigured to cooperate with the replaced door. The modular recessed dispensers may be fully recessed or semi-recessed into a wall or other structure.

10 Claims, 4 Drawing Sheets

(56) References Cited

U.S. PATENT DOCUMENTS 5,255,971 A * 10/1993 Aisley ..... A47B 67/02 312/242
5,405,196 A * 4/1995 Shoup ..... A47B 96/061 248/488
5,484,196 A * 1/1996 Kim ..... A47B 67/02 211/90.01
5,528,810 A * 6/1996 Eddy ..... B67D 3/00 29/401.1
5,562,163 A * 10/1996 Sartain ..... A62C 35/20 169/51
5,624,170 A * 4/1997 Hasty ..... A47B 96/00 16/382
5,950,382 A 9/1999 Martino
6,089,685 A * 7/2000 Ryan ..... A47B 57/10 312/291
D445,028 S 7/2001 Grubstein
6,296,181 B1 * 10/2001 Noblet ..... A47G 29/1201 232/24
6,651,827 B1 11/2003 Eberwein
D493,312 S 7/2004 Collins et al.
6,820,753 B2 11/2004 Kurtz
6,913,369 B2 * 7/2005 Chadwick ..... B28B 7/346 362/147
7,004,435 B2 2/2006 Formon
D520,277 S 5/2006 Smiley et al.
D524,084 S 7/2006 Wieser et al.
D526,165 S 8/2006 Burns et al.
D550,008 S 9/2007 Hager et al.
D552,428 S 10/2007 Zeiron
D579,249 S 10/2008 Omdoll et al.
D590,213 S 4/2009 Young et al.
D604,996 S 12/2009 Kuehneman et al.
D604,997 S 12/2009 Kuehneman et al.
7,762,635 B2 * 7/2010 Spoljaric ..... A61F 17/00 312/245
D626,362 S 11/2010 Martin
D630,873 S 1/2011 Kuehneman et al.
D648,187 S 11/2011 Kuehneman et al.
8,152,021 B2 4/2012 Babikian
D665,209 S 8/2012 Vasquez
D669,715 S 10/2012 Silagy
8,424,982 B1 * 4/2013 Schwartz ..... A47B 67/02 312/227
D705,017 S 5/2014 Siebel
8,931,663 B1 1/2015 Evans et al.
9,624,027 B2 4/2017 DeGraaf
2004/0263029 A1 * 12/2004 Scholefield ..... A47G 29/141 312/242
2006/0119235 A1 * 6/2006 Aisley ..... A47B 47/00 312/242
2006/0243618 A1 * 11/2006 Brown ..... B65D 5/722 206/366
2011/0115351 A1 * 5/2011 McManic ..... A47B 45/00 312/270.1
2011/0279001 A1 * 11/2011 Peters ..... A47B 67/00 312/209
2012/0169196 A1 * 7/2012 Marchetti ..... E06B 3/721 312/265.6
2012/0228323 A1 9/2012 Fujimoto
2014/0361024 A1 12/2014 DeGraaf
2015/0182076 A1 * 7/2015 Berke ..... A47K 3/281 312/209
2015/0374121 A1 * 12/2015 Wood ..... A47B 67/02 312/242
2017/0008691 A1 1/2017 DeGraaf
2017/0036847 A1 2/2017 Henson et al.

* cited by examiner

RECESSED PERSONAL PROTECTION EQUIPMENT DISPENSERS

PRIORITY CLAIM

The present application claims the benefit of the filing date of U.S. patent application Ser. No. 14/708,673, which claims the benefit of the filing date of U.S. Provisional Patent Application No. 61/832,099, and wherein the subject matter of these applications are incorporated by reference herein in their entireties.

FIELD OF THE INVENTION

The present invention generally relates to personal protection equipment (PPE) dispensers for organizing and dispensing consumable goods such as, but not limited to, gloves, facemasks, gowns, wipes, and pads for industries such as, but not limited to, medical, healthcare, education, foodservice, automotive, and industrial, and more specifically relates to modular PPE dispensers recessed or semi-recessed into a wall or other structure.

SUMMARY

The present invention generally relates to modular PPE dispensers recessed or semi-recessed into a wall or other structure (hereinafter referred to as a "modular recessed dispenser"), and where the modular recessed dispenser is configured to hold consumables boxes containing consumable products such as, but not limited to, disposable latex gloves, facemasks, gowns, wipes, and pads for industries such as, but not limited to, medical, healthcare, education, foodservice, automotive, and industrial.

In one aspect of the present invention, a dispenser kit recessed into an opening of a structure includes a dispenser body; a dispenser frame; interchangeable doors attachable to the frame with releasable hinges, wherein a first door includes first access openings and a second door includes second access openings that are configured differently as compared to the first access openings, wherein the dispenser body and the dispenser frame both remain in situ when the doors are interchanged; and adjustable shelves, dividers or both arranged within the dispenser body.

In another aspect of the present invention, a dispenser kit recessed into an opening of a structure includes a dispenser body; a dispenser frame; interchangeable front panels releasably attachable to the frame, wherein a first front panel includes first access openings and a second front panel includes second access openings that are configured differently as compared to the first access openings, wherein the dispenser body and the dispenser frame both remain in situ when the front panels are interchanged; and adjustable shelves, dividers or both arranged within the dispenser body.

BRIEF DESCRIPTION OF THE DRAWINGS

In the drawings, identical reference numbers identify similar elements or acts. The sizes and relative positions of elements in the drawings may not be necessarily drawn to scale. For example, the shapes of various elements and angles may not be drawn to scale, and some of these elements may be arbitrarily enlarged or positioned to improve drawing legibility. Preferred and alternative embodiments of the present invention are described in detail below with reference to the following drawings.

DETAILED DESCRIPTION

In the following description, certain specific details are set forth in order to provide a thorough understanding of various embodiments of the invention. However, one skilled in the art will understand that the invention may be practiced without these details. In other instances, well-known structures associated with dispensers and organizers for consumable goods, assemblies and subassemblies of the same, and methods of using, assembling and installing any of the above have not necessarily been shown or described in detail to avoid unnecessarily obscuring descriptions of the embodiments of the invention.

The present invention generally relates to modular PPE dispensers recessed into a wall or other structure (hereinafter referred to as a "modular recessed dispenser"), and where the modular recessed dispenser is configured to hold consumables boxes containing consumable products such as, but not limited to, disposable latex gloves, facemasks, gowns, wipes, and pads for industries such as, but not limited to, medical, healthcare, education, foodservice, automotive, and industrial. Consumable products are generally products that are used once and then discarded, but consumable products may also include products that are reusable and replaceable into the modular recessed dispenser after the product has been extracted therefrom. It is understood that the term "recessed" should be broadly interpreted to mean fully recessed, partially recessed or semi-recessed for the purposes of the present description. In one embodiment, modular recessed dispenser is configured to be recessed into new or existing mountable structure, including but not limited to walls, doors and cabinetry. The modular recessed dispenser may include a hinged door with quick release hinges, interchangeable adjustable shelves and dividers, and a replaceable door or front panel. The shelving and door/panel are modular in the sense they permit someone to customize and reconfigure the modular recessed dispenser for completely different uses without necessitating any remodeling or demolition of the mountable structure.

Figure 1:
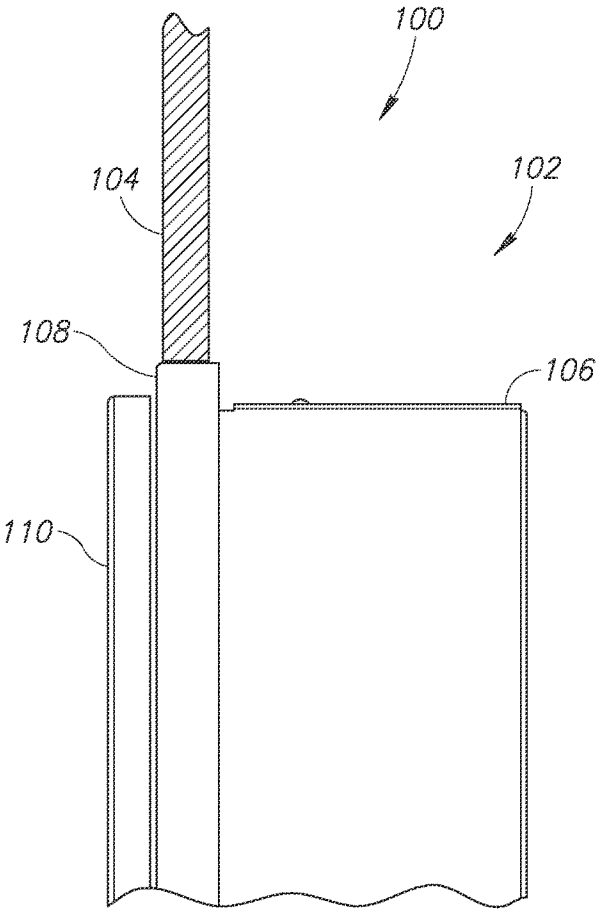
FIG. 1 is a cross-sectional view of a modular recessed dispenser according to an embodiment of the present invention.

FIG. 1 shows a first installation 100 in which a modular recessed dispenser 102 is fully recessed into a structure 104. The modular recessed dispenser 102 includes a body 106 and a frame 108 in which the latter is attached to and aligned within an opening of the structure 104. The modular recessed dispenser 102 further includes a door or front panel 110, which will be described in more detail below.

Figure 2:
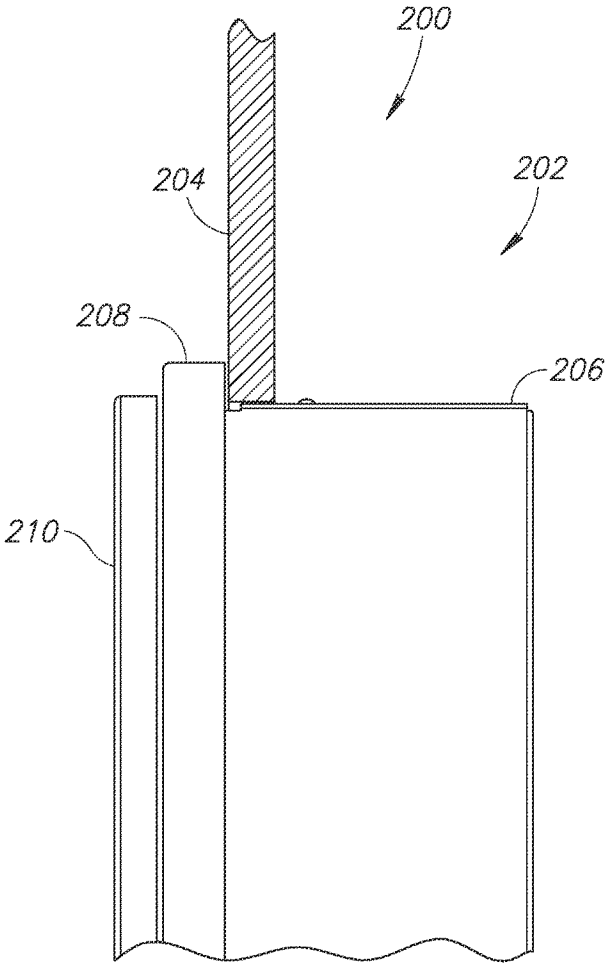
FIG. 2 is a cross-sectional view of a modular semi-recessed dispenser according to another embodiment of the present invention.

FIG. 2 shows a first installation 200 in which a modular recessed dispenser 202 is partially or semi-recessed into a structure 204. The modular recessed dispenser 202 includes a body 206 and a frame 208, in which the latter abuts an outer surface perimeter area that defines an opening of the structure 204. The modular recessed dispenser 202 may also include a door or front panel 210.

Figure 3:
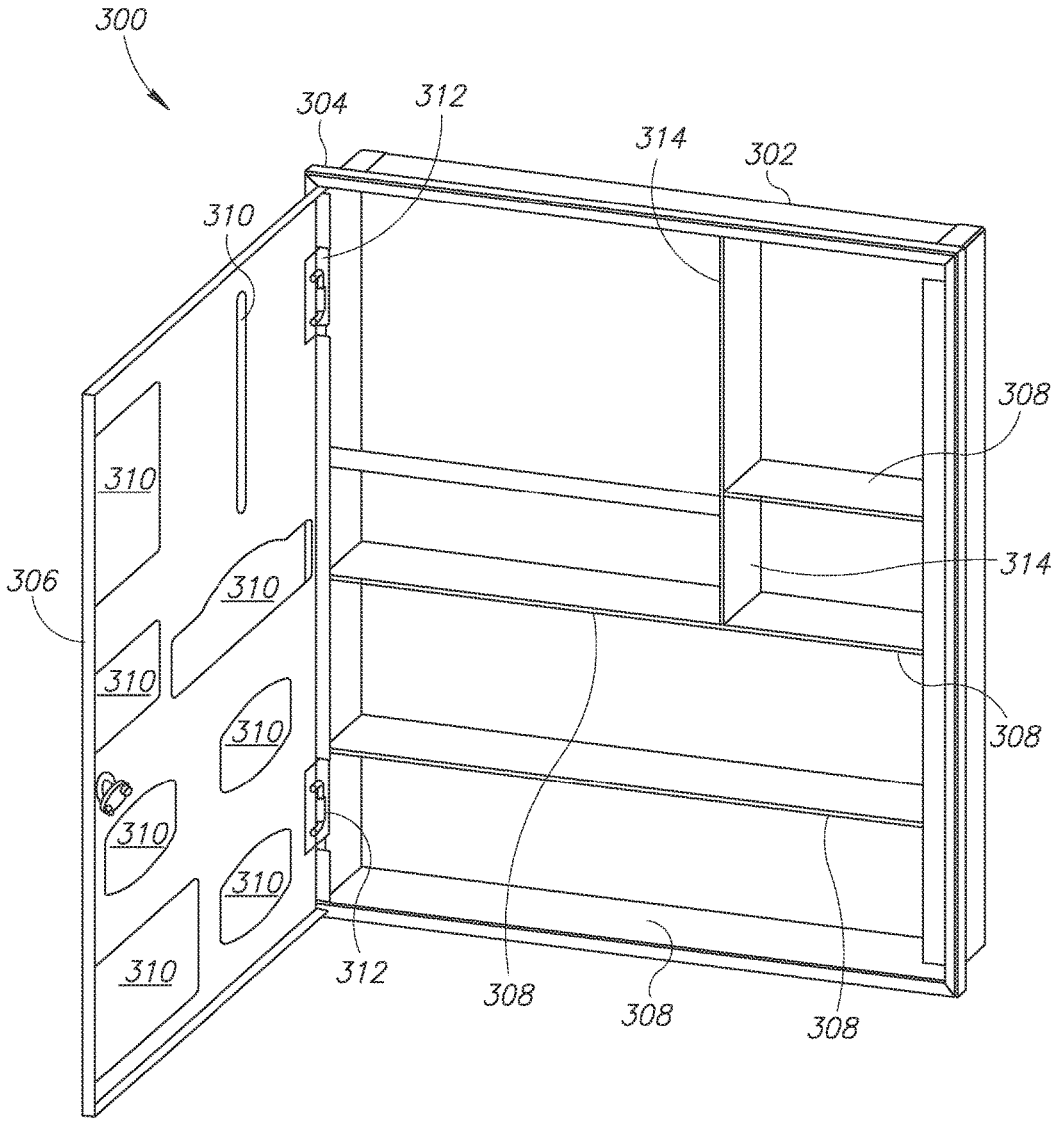
FIG. 3 is a top, front, left perspective view showing a modular recessed dispenser according to another embodiment of the present invention.

FIG. 3 shows a modular recessed dispenser 300 having a body 302, a frame 304 and a door 306 according to another embodiment of the present invention. The frame 304 is coupled to or formed integrally with the body 302 and one or both may be recessed in a structure (not shown). The body 302 includes a plurality of shelves 308 that may be arranged in a variety of ways to cooperate and/or sufficiently align with consumable cutouts 310 formed in the door 306.

In a preferred embodiment, the door 306 includes releasable hinges 312, which may take the form of quick release hinges. The door 306 may be removed and replaced with a different door having different shaped cutouts, similar cutouts arranged in a different pattern or some combination thereof. Likewise, the shelves 308 and dividers 314 may be adjusted, replaced or re-arranged to cooperate with the different door, thus making the dispenser 300 modular in the sense that the body 302 and the frame 304 may remain in situ while the other components of the dispenser 300 are reconfigured. The modularity of the door 306, the shelves 308 and the dividers 314 may advantageously minimize or eliminate remodeling, demolition or re-shaping of the opening in the structure (not shown).

Figure 4:
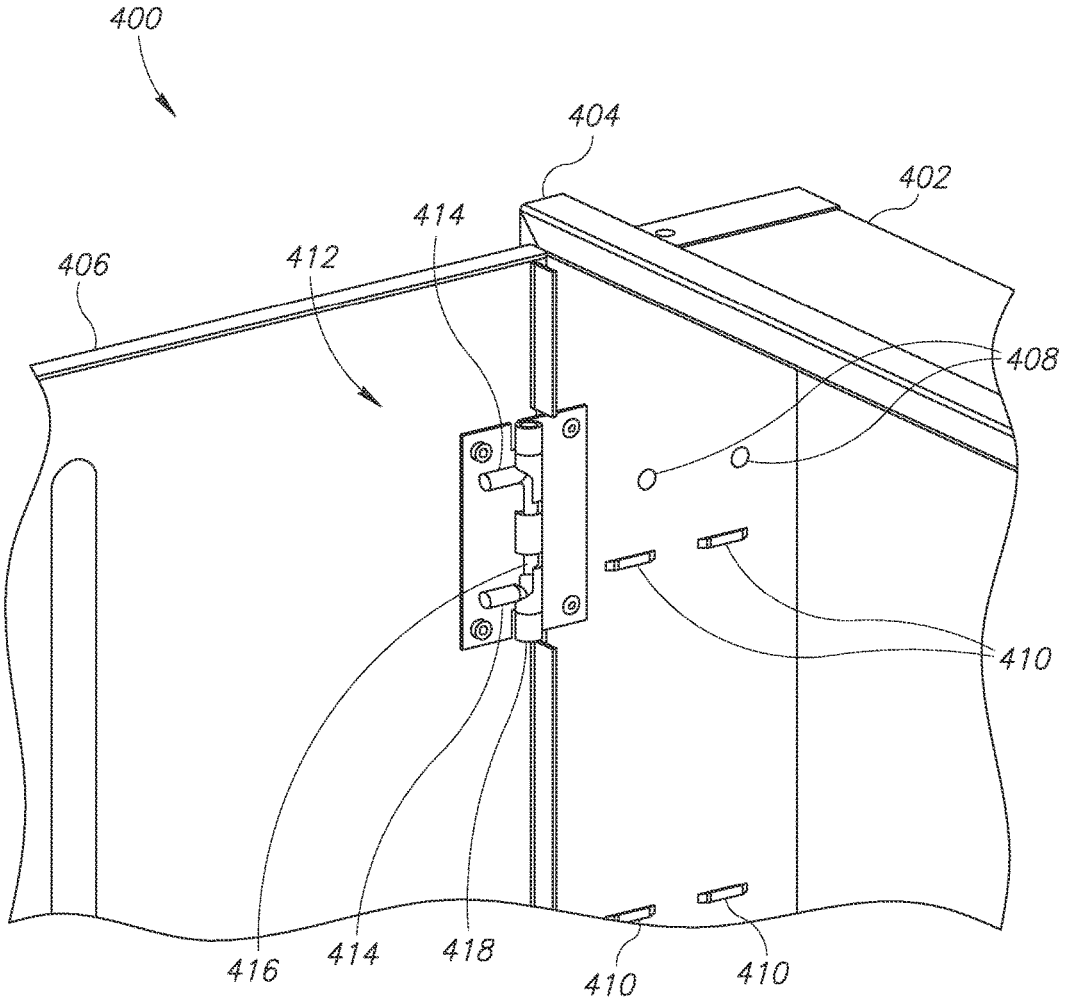
FIG. 4 is a top, front, left perspective and close-up view showing a modular recessed dispenser with releasable hinges according to another embodiment of the present invention.

FIG. 4 shows a modular recessed dispenser 400 having a body 402, a frame 404 and a door 406 according to another embodiment of the present invention. The body 402 includes mounting holes 408 and adjustable shelving supports 410. The door 406 is rotationally coupled to the frame 404 with a quick release hinge assembly 412. In one embodiment, the hinge assembly 412 includes arms 414 coupled to a spindle 416, which is at least partially received within a sleeve 418. Pinching the arms 414 together allows the spindle 416 to be quickly released from the sleeve 418 and the door 406 to be removed and replaced.

Figure 5:
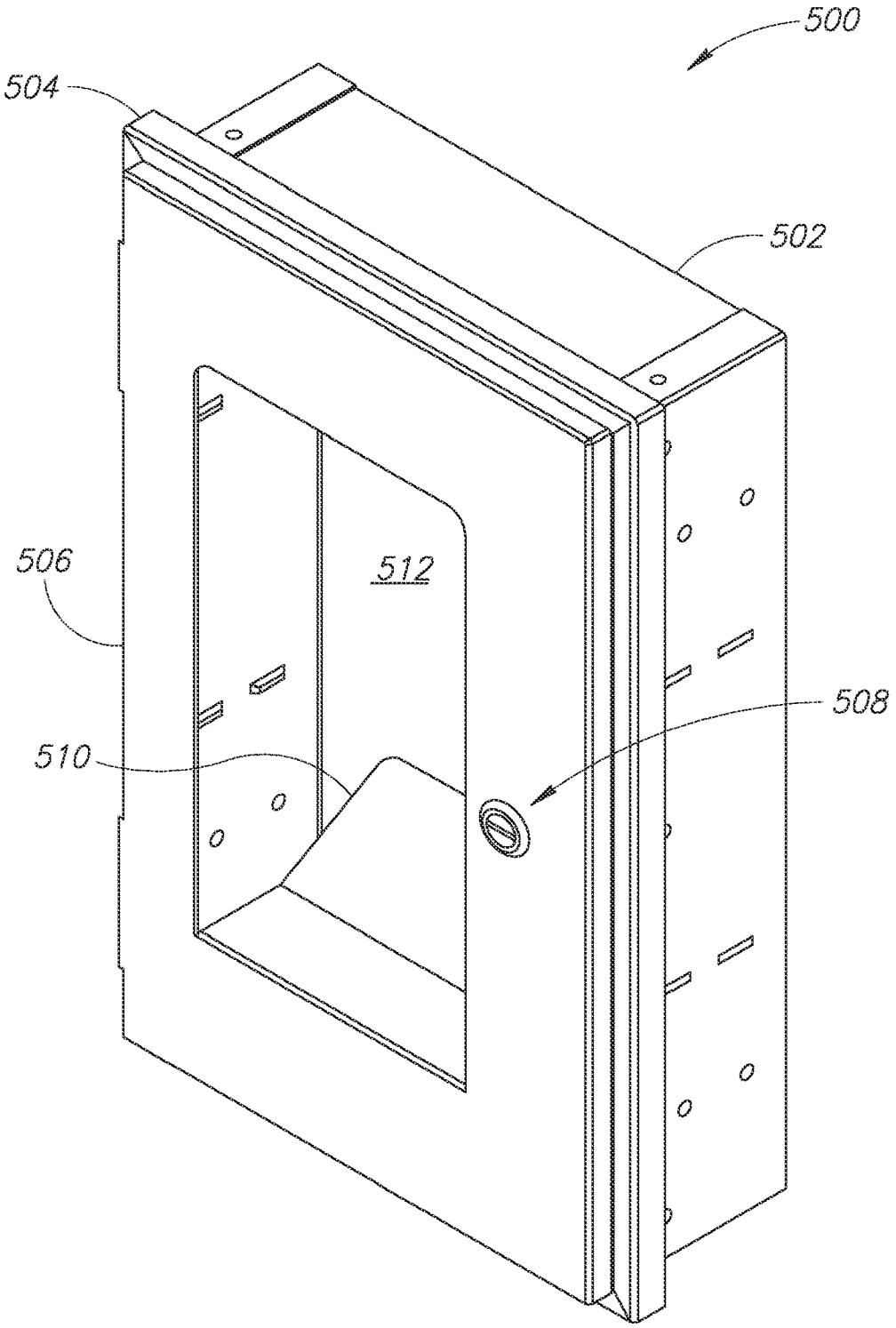
FIG. 5 is a top, front, right perspective view showing a lockable modular recessed dispenser according to another embodiment of the present invention.

FIG. 5 shows a modular recessed dispenser 500 having a body 502, a frame 504 and a door 506 according to another embodiment of the present invention. In the illustrated embodiment, the door 506 includes a lock 508 to secure the door 506 to the frame 504, the body 502 or both. In another embodiment, the lock 508 may be replaced with a latch or both a lock and a latch may be included in the assembly of the door. Although the lock is shown as a standard key-type lock, it is appreciated that the lock may be a digital, magnetic or electronic-type lock. In addition, the body 502 may include a cantilevered shelf 510 configured to biasly urge consumable products (e.g, a box containing medical gowns) toward an opening 512 in the door 506.

The modular recessed dispensers described herein may have hinged doors with or without locks. While the modular recessed dispensers have been described herein with regards to a medical or healthcare application, it is appreciated that such dispensers may be used in a variety of other applications such as, but not limited to, a medicine dispenser, a janitorial supply dispenser, a first aid or safety product dispenser, a tool dispenser, an art supply dispenser, a food item dispenser (e.g., spices, pantry items, foil, plastic wrap, waxed paper, etc.), a sewing item dispenser, and an educational item dispenser (e.g., teacher and/or student supply dispenser locatable in a classroom or school hallway).

Further, the doors may be made from a variety of materials to include, but not limited to, reflective (e.g., mirror), white board, chalkboard, corkboard, magnetic, stainless steel, powder-coated, laminated, composite, plastic, or glass.

The various embodiments described above can be combined to provide further embodiments. All of the above U.S. patents, patent applications and publications referred to in this specification are incorporated herein by reference. Aspects can be modified, if necessary, to employ devices, features, and concepts of the various patents, applications and publications to provide yet further embodiments.

These and other changes can be made in light of the above detailed description. In general, in the following claims, the terms used should not be construed to limit the invention to the specific embodiments disclosed in the specification and the claims, but should be construed to include all types of dispensers, organizers and methods of making and installing the same that operate in accordance with the claims. Accordingly, the invention is not limited by the disclosure, but instead its scope is to be determined entirely by the following claims

The invention claimed is:

1. A dispenser kit for dispensing consumable objects, where the dispenser kit is at least partially receivable into an opening of a structure, the dispenser kit comprising:

a dispenser body defining a predetermined configuration of mounting structures;

a dispenser frame;

first and second interchangeable doors;

releasable hinges for detachably attaching the first and second interchangeable doors to the dispenser frame; and first and second shelf structures detachably attachable to the dispenser body by at least one of the mounting structures; wherein the first shelf structure is adapted to be arranged in a first shelf configuration relative the dispenser body;

the second structure is adapted to be arranged in a second shelf configuration relative to the dispenser body;

the first door includes at least one first cutout, where the at least one first cutout in the first door is configured to cooperate with the first shelf structure in the first shelf configuration to allow access to consumables stored on the first shelf structure in the first shelf configuration;

the second door includes at least one second cutout, where the at least one second cutout in the second door is configured to cooperate with the second shelf structure in the second shelf configuration to allow access to consumables stored on the second shelf structure in the second shelf configuration;

the at least one first cutout in the first door is configured differently than the at least one second cutout in the second door;

the first shelf configuration is configured differently than the second shelf configuration;

the configuration of the at least one first cutout in the first door is predetermined relative to the first shelf configuration such that, when the first door is detachably attached to the dispenser frame with the first shelf structure in the first shelf configuration, consumable objects supported by the first shelf structure may be accessed through the at least one first cutout; and the configuration of the at least one second cutout in the second door is predetermined relative to the second shelf configuration such that, when the second door is detachably attached to the dispenser frame with the second shelf structure in the second shelf configuration, consumable objects supported by the second shelf structure may be accessed through the at least one second cutout;

the dispenser kit operates in a first kit configuration in which the first door is detachably attached to the dispenser body to allow the first door to be rotated between loading and dispensing configurations relative to the dispenser body, the first shelf assembly is arranged in the first shelf configuration relative to the dispenser body, and the second door and the second shelf assembly are detached from the dispenser body; and the dispenser kit operates in a second kit configuration in which the second door is detachably attached to the dispenser body to allow the second door to be rotated between loading and dispensing configurations relative to the dispenser body, the second shelf assembly is arranged in the second shelf configuration relative to the dispenser body, and the first door and the first shelf assembly are detached from the dispenser body.

2. The dispenser kit of claim 1, wherein the releasable hinges are quick release hinges.

3. The dispenser kit of claim 1, wherein the dispenser body and the dispenser frame are both recessed into the opening formed in the structure.

4. The dispenser kit of claim 1, wherein the dispenser body is recessed into the opening formed in the structure while the dispenser frame abuts an external surface of the structure.

5. The dispenser kit of claim 1, further comprising:

at least one divider; and the at least one divider is detachably attached to the dispenser body when the dispenser kit is in the first shelf configuration.

6. A dispenser kit for dispensing consumable objects, where the dispenser kit is at least partially receivable into an opening of a structure, the dispenser kit comprising:

a dispenser body defining a predetermined configuration of mounting structures;

a dispenser frame;

first and second interchangeable doors;

releasable hinges for detachably attaching the first and second interchangeable doors to the dispenser frame;

a first shelf structure configurable in a first shelf configuration relative the dispenser body; and a second shelf structure configurable in a second shelf configuration relative to the dispenser body; wherein the first shelf configuration is configured differently than the second shelf configuration;

the first door includes at least one first cutout, where a configuration of the first cutout is predetermined to cooperate with the first shelf configuration;

the second door includes at least one second cutout, where a configuration of the second cutout is predetermined to cooperate with the second shelf configuration;

the at least one first cutout is configured differently than the at least one second cutout and;

the dispenser kit is configured in the first shelf configuration with the first door attached to the dispenser frame, where the at least one first cutout is configured to cooperate with the first shelf structure with the dispenser kit in the second shelf configuration such that consumable objects supported by the first shelf structure may be accessed through the at least one first cutout;

the dispenser kit is reconfigured from the first shelf configuration to the second shelf configuration with the second door attached to the dispenser frame, where the at least one second cutout is configured to cooperate with the second shelf structure with the dispenser kit in the second shelf configuration such that consumable objects supported by the second shelf structure may be accessed through the at least one second cutout;

the dispenser kit operates in a first kit configuration in which the first door is detachably attached to the dispenser body to allow the first door to be rotated between loading and dispensing configurations relative to the dispenser body, the first shelf assembly is arranged in the first shelf configuration relative to the dispenser body, and the second door and the second shelf assembly are detached from the dispenser body; and the dispenser kit operates in a second kit configuration in which the second door is detachably attached to the dispenser body to allow the second door to be rotated between loading and dispensing configurations relative to the dispenser body, the second shelf assembly is arranged in the second shelf configuration relative to the dispenser body, and the first door and the first shelf assembly are detached from the dispenser body.

7. The dispenser kit of claim 6, wherein the releasable hinges are quick release hinges.

8. The dispenser kit of claim 6, wherein the dispenser body and the dispenser frame are both recessed into the opening formed in the structure.

9. The dispenser kit of claim 6, wherein the dispenser body is recessed into the opening formed in the structure while the dispenser frame abuts an external surface of the structure.

10. The dispenser kit of claim 6, further comprising:

at least one divider; and the at least one divider is detachably attached to the dispenser body when the dispenser kit is in the first shelf configuration.

* * * * *